United States Patent [19]

Hoinski

[11] 4,187,797

[45] Feb. 12, 1980

[54] THRESHOLD PLATE DOOR ALARM

[75] Inventor: Walter W. Hoinski, Norristown, Pa.

[73] Assignee: Power Systems Development Corporation, Wilmington, Del.

[21] Appl. No.: 898,422

[22] Filed: Apr. 20, 1978

[51] Int. Cl.[2] ..... G08B 13/08

[52] U.S. Cl. ..... 116/87; 42/1 TB

[58] Field of Search ..... 116/87, 83, 85, 86, 116/82, 100, 89; 42/1 TB

[56] References Cited

U.S. PATENT DOCUMENTS

| | | | |
|---|---|---|---|
| 11,131 | 6/1854 | McDugall | 116/87 X |
| 61,061 | 1/1867 | Fitzhugh | 116/87 |
| 252,095 | 1/1882 | Giles | 116/87 |
| 718,211 | 1/1903 | Lombard | 116/87 |

*Primary Examiner*—Daniel M. Yasich
*Attorney, Agent, or Firm*—Paul & Paul

[57] ABSTRACT

A door alarm apparatus, for signaling when a door has been jimmied or otherwise set ajar, is provided having a member which may be propped or otherwise jammed against a door, this door being in the normally closed position, for activating an alarm connected to this member where the member may be positioned in a fixed and predetermined spatial relationship to the threshold plate of the door whereby an anchoring component part of the may slidably mate with an anchoring component affixed to the threshold plate.

9 Claims, 2 Drawing Figures

THRESHOLD PLATE DOOR ALARM

BACKGROUND OF THE INVENTION

Door alarm apparatus of the propped-against type have been developed in the past. These apparatus are intended to be set up in front of a door, once the door has been closed, and have the feature that they are intended only for temporary installation, when the door is closed and not in use. This invention relates to such door alarm apparatus and more specifically to those apparatus adapted to hold or otherwise activate a handgun shaped alarm member.

Such apparatus in the past have taken principally two formats. The first is an apparatus wherein the activating member is jammed against the door and frictionally held in position with respect to the floor surface behind the door. Such frictional holding has been assured by usually a large frictional surface area of the apparatus in contact with the floor, or, alternately, has been assured by a wedging member digging into or otherwise scraping along the floor mounting ever increasing resistance as the door is opened thereagainst.

The second format includes the fixed mounting of the apparatus to the wall immediately adjacent the door.

These prior art teachings exhibit certain shortcomings which this invention hopes to overcome. Particularly, those which are permanently mounted to the wall area adjacent the door are undesirable as they are not readily removable when the door is in use. Those which wedge or frictionally act against with the floor are also undesirable as they may easily be knocked over or dislodged from their intended position by a child or pet who brushes against them. Moreover, they provide no precise fixed reference point with respect to the closed position of the door. Such latter type devices may be wedged tightly against the door in a first installation and not so tightly against the door in a second installation. Moreover, for those of this type which are propped or lean against the door the angle at which they are leaned against the door may vary from use to use.

It is important to develop such an easily removable alarm apparatus which is easily installed to a predetermined and fixed spatial frame of reference with respect to the closed door. This enables a precise adjustment of the trigger mechanism which assures uniform operation not generally available with prior devices. It is also desirable to provide such an apparatus with a secured anchorage which will prohibit the apparatus from being dislodged from its operational position by the movements of a child or a pet.

An object of this invention is to provide a threshold plate door alarm which alarm may be securely attached to the threshold plate in a predetermined and fixed spatial association with the closed door.

A second object of this invention is to provide such an apparatus which may be securely anchored in such predetermined position.

A third object of this invention is to provide such an apparatus which is easily removable from its installed position.

A further object of this invention is to provide an activator and carriage for communicating with and operating a handgunlike shaped audible alarm member.

SUMMARY OF THE INVENTION

The objectives of this invention are achieved in a threshold plate door alarm apparatus which may include a carriage component suitable for positioning and supporting a handgun-shaped audible alarm component. Extending outwardly from the carriage may be an anchoring hook which may by inserted into an anchoring receptacle permanently mounted on the inside of the threshold plate of a door. This hook may include a canted barb which may mate with a canted receiving hole in the anchor plate.

An activating rod may be wedged between the closed door and the activating trigger of the audible alarm component. This activating rod which is preferably interchangeable as to various predetermined lengths may be wedged against the door in the horizontal position and may exert a predetermined pressure against the trigger of the audible alarm component as a function of the fixed distance between the closed door and the trigger member of the audible alarm component, such pressure being determinative of the pressure and movement by the door necessary to set off the alarm.

DESCRIPTION OF THE DRAWINGS

The operation, advantages and structural features of the invention can easily be understood from a reading of the following detailed description of the invention in conjunction with the accompanying drawings in which like numerals refer to like elements, and in which.

DETAILED DESCRIPTION OF THE INVENTION

Figure 1:
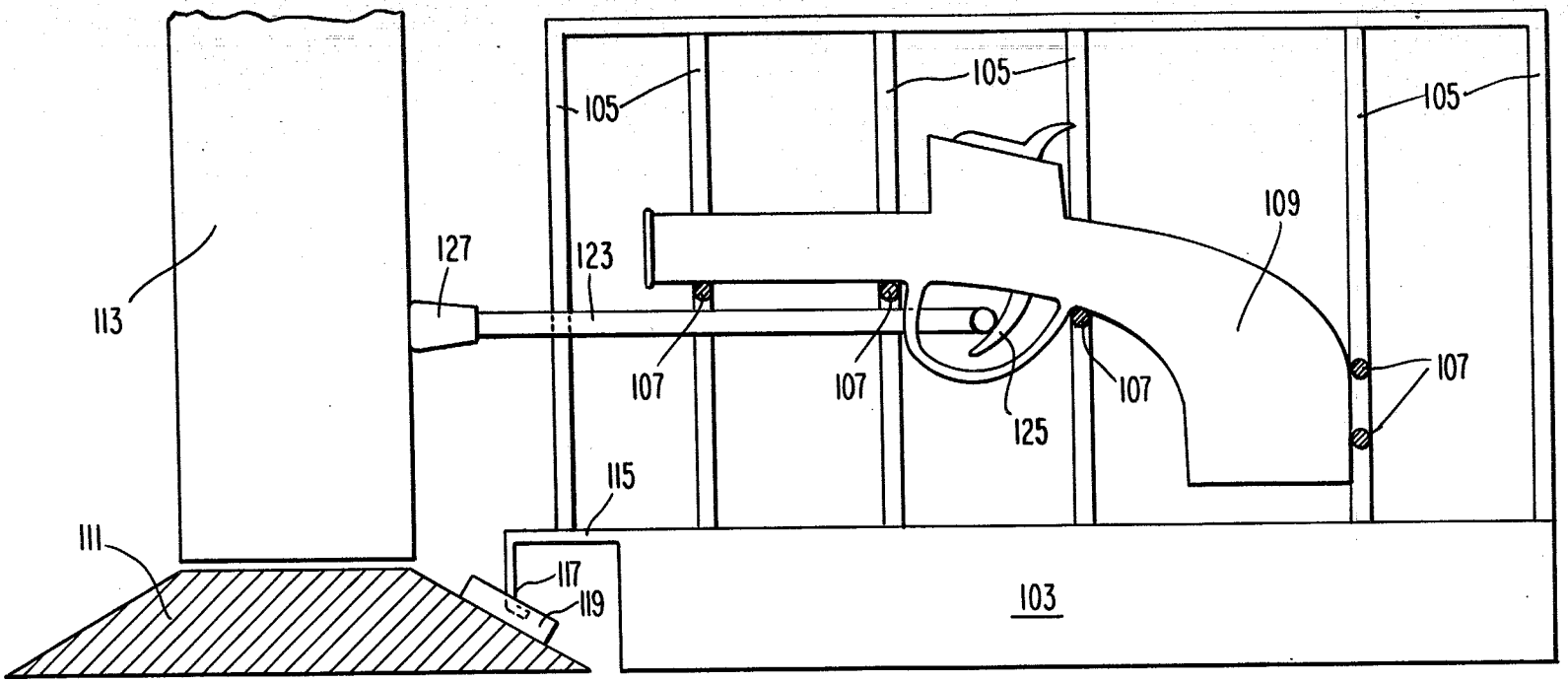
FIG. 1 shows the assembled threshold plate alarm apparatus.

A removable threshold plate door burglar alarm apparatus includes a carriage member 101, FIG. 1, which carriage member comprises a base plate 103 and a plurality of vertical supports 105. Vertical supports 105 have connected therebetween a plurality of horizontal supports 107 which horizontal supports 107 are positioned to cradle and securely hold a handgun-shaped audible alarm component 109.

Handgun-shaped alarm component 109 is wedged between the vertical and horizontal supports 105, 107 of the carriage 101 to be securely positioned with respect thereto. While the handgun alarm component 109 may be inserted into the carriage 101 from above and may have limited free movement forward with respect to this carriage 101, it is absolutely stopped and cradled from further movement with respect to the downward and backward directions.

Carriage 101 is positionable in close proximity to the threshold plate 111 of a closed door 113. The carriage base 103 rests upon the floor. An anchoring hook 115 extends outwardly from the carriage base 101 towards the door 113 in a generally horizontal direction. This anchoring hook 115 includes an extended canted barb portion 117 thereof.

Figure 2:
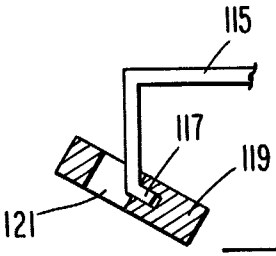
FIG. 2 is a detail of the anchor plate and the canted barb of the anchoring hook shown in FIG. 1.

Mounted on the inside slanting portion of the threshold 111 is a shallow anchor plate 119. This anchor plate 119, FIG. 2, includes a receiving hole 121 of a shape and dimensions for slidably receiving the canted barb portion 117 of the anchoring hook 115 for inhibiting movement of this barb 117 with respect to a direction away from the closed door 113, as well as, a direction laterally, left or right, with respect to the closed door 113.

An activating rod 123, FIG. 1, is wedged between the closed door 113 and a trigger portion 125 of the handgun-shaped alarm component 109. This activating rod is positioned with sufficient force to hold it essentially horizontally between the closed door 113 and the trigger member 125, having a shape at the trigger mating end for conformally mating with the trigger 125.

A flexible cap or bushing 127 is positioned over the door mating and on the activating rod 123. This cap is compressible efficiently to wedge the activating rod to its operating position without moving the trigger member 125 of the alarm component 109.

In operation, the alarm apparatus may easily be installed or removed from its position against the door 113. In the installed position it is securely anchored with respect to the threshold plate 111 and is not easily moved or jarred out of position by a bump or a vibration caused by running feet or the playful activity of children or pets. More importantly, the length of the anchoring hook 115 and its mating with the anchor plate 119 predetermines the position of the carriage base 103 on the floor with respect to the closed door 113. Therefore, the distance between the trigger member 125 and the closed door 113 is predetermined and constant from installation to installation. This provides for a predetermined and constant pressure exerted by the operating rod 123 and the compressed rod cap 127. The activating force and distance of movement by the door 113 is therefore predetermined for each installation.

While the apparatus described herein may have many embodiments existing within the thrust and scope of the invention with many of the various elements described above being constructed of a variety of materials, as an example, the elements set forth herein may be constructed of materials as follows. The carriage 101 including its base 103 and vertical and horizontal supports 105, 107 can be made of polyethylene, polypropylene, or polycarbonite "plastic" material of sufficient thickness and strength to support the handgun shaped alarm component 105 and securely hold this component against the trigger member 125 operating pressure. Handgun shaped audible alarm component 109 can be a diecast structure made of aluminum white metal, or other readily available material. A spring loaded anvil, light explosive cap, air percussion member or other mechanism may be employed for providing an audible alarm, which mechanism may be triggered by the physical movement of trigger member 125.

Anchor plate 119 is preferably constructed of metal such as brass or aluminum which may easily be anchored to the threshold plate 111 by means of wood screws. Anchor hook 115 including the canted barb 117 may also be made of metal such as brass, bronze or aluminum which will permit a narrow conformation while providing sufficient strength for the hook 115. The hook 115 may have a swedged or otherwise flat end which can be bolted, clamped or screwed to the carriage base 103. The manufacture of the hook 115 of metal will assure that the barb 117 which extends vertically downwardly from the essentially horizontal extension of the hook 115 and then is canted at an angle backwardly toward the carriage base 103 to lock into the receiving hole 121 of the anchoring plate 119 will have sufficient strength to resist operational stresses placed thereupon.

Anchor plate 119 receiving hole 121 includes a first bore extending orthogonally thereinto and a secondary bore extending at an angle into the sidewall of the first bore for receiving the canted barb 117.

Activating rod 123 may be made of polycarbonite or other high-strength plastic, or reinforced fiberglass or metal of sufficient diameter to eliminate a bending of the rod 123 under the force of the opening door 113. Rubber cap 127 may be made of butal rubber or other crushible resilient material.

The apparatus is inserted into the operating position by sliding the anchoring hook 115 and barb 117 downwardly and backwardly away from the door. Activating rod 123 is then wedged into position.

The carriage base 103, vertical supports 105 and horizontal supports 105 can be made of various sizes and with various spaces between members in order to support and cradle an audible alarm component 109 of different shapes and sizes. Each carriage 101 could be sized for a specific alarm component 109.

As with specifying the base 103, vertical supports 105 and horizontal supports 105 to be of various sizes, the activating rod 123 can be of any one of various predetermined lengths depending upon the dimensions of the carriage 101 components and of the alarm component 109 it is to be used with. Normally, the trigger engaging end of this activating rod 123 conforms to the shape of the trigger.

Alarm component 109 need not be made in the shape of a hand gun. While the aesthetic appearance of this component 109 may be altered the functional operation may be just as well satisfied by an alarm component 109 of another shape.

The structural dimensions of the carriage base 103, anchoring hook 115 and canted barb portion 117 as well as the materials of which they are made may play an additional role in providing security for the door. If the carriage base 103 is of a sufficient height to enable the hook 115 and barb portion 117 to intercept the door 113 as it swings open, they can act to impede or limit the amount of opening of the door 113 after the alarm 109 has been energized. This structure therefore provides a positive stop of the door motion prohibiting intrusion.

The structural strength of the base 103, anchoring hook 115, canted barb portion 117 and anchor plate 119 must be sufficient to resist an intruder under such design considerations. The length of the hook 115 determines the distance the door 113 swings open before engaging this mechanical stop.

Alternate embodiments of the invention described herein may be made without departing from the intent and scope of the invention presented. It is therefore the intent of this disclosure to act as an illustrative presentation of the invention and not to limit the subject invention to the precise embodiment provided herein.

What is claimed:

1. A door threshold alarm apparatus for use in combination with a door and the threshold plate thereof, comprising:

elongated means for sensing door movement, said sensing means being in contact with said door when closed;

an alarm component operatively connected to said sensing means;

anchoring means attachable to said door threshold plate; and support means for securedly holding said alarm component, said support means having an extended portion being slidably connectable to and removeable from said threshold plate anchoring means, for selectively securedly positioning said alarm component at a predetermined spacing from said door when closed.

2. The apparatus of claim 1 wherein said support means when slidably connected to said threshold plate anchoring means is securedly positioned with respect thereto, said support means thereby providing a positive stop against said door opening.

3. The apparatus of claim 2 wherein said support means includes:

a carriage component capable of supporting said alarm component;

an anchoring hook extending from said carriage component; and a barb being canted from said anchoring hook for slidably mating with said anchoring means.

4. The apparatus of claim 3 wherein said barb cant extends backwardly toward said carriage component.

5. The apparatus of claim 4 wherein said anchoring means includes an anchoring plate attached to the inside of said door threshold plate, said anchoring plate containing a first bore and a secondary bore, said secondary bore extending at an angle into the sidewall of said first bore and being matable with and slidably receivable of said canted barb hook.

6. The apparatus of claim 5 wherein said carriage component includes:

a base;

a plurality of vertical supports extending upwardly from said base; and a plurality of horizontal supports extending horizontally between said vertical supports;

said vertical and horizontal supports all being positioned to cradle said alarm component.

7. The apparatus of claim 6 wherein said alarm component is handgun shaped with a trigger activator, said activator being connected to said door movement sensing means.

8. The apparatus of claim 7 wherein said door movement sensing means includes an activating rod propped between said door and said gunshaped alarm component trigger.

9. The apparatus of claim 8 wherein said activating rod includes a compressible tip for mating with said door.

* * * * *

UNITED STATES PATENT OFFICE

CERTIFICATE OF CORRECTION

Patent No. 4,187,797 Dated February 12, 1980

Inventor(s) Walter W. Hoinski

It is certified that error appears in the above-identified patent and that said Letters Patent are hereby corrected as shown below:

In the abstract, line 9, after the word "the" insert -- member -- .

Signed and Sealed this

*Seventeenth* Day of *June 1980*

[SEAL]

*Attest:*

SIDNEY A. DIAMOND

*Attesting Officer*

*Commissioner of Patents and Trademarks*